United States Patent [19]

Satoh

[11] 4,233,588

[45] Nov. 11, 1980

[54] ELEVATOR POSITION DETECTOR

[75] Inventor: Tsuyoshi Satoh, Inazawa, Japan

[73] Assignee: Mitsubishi Denki Kabushiki Kaisha, Tokyo, Japan

[21] Appl. No.: 34,008

[22] Filed: Apr. 27, 1979

[30] Foreign Application Priority Data

May 29, 1978 [JP] Japan ..... 53/63995

[51] Int. Cl.[2] ..... G08B 21/00; B66B 3/02

[52] U.S. Cl. ..... 340/21; 368/120; 340/686; 343/112 D

[58] Field of Search ..... 340/21, 686; 343/112 D; 324/188

[56] References Cited

U.S. PATENT DOCUMENTS

| | | | |
|---|---|---|---|
| 3,199,630 | 8/1965 | Engel et al. | 340/21 X |
| 3,204,180 | 8/1965 | Bray et al. | 324/188 |
| 3,219,925 | 11/1965 | Borley et al. | 340/686 X |
| 4,041,495 | 8/1977 | Martin | 340/21 X |

*Primary Examiner*—David L. Trafton

*Attorney, Agent, or Firm*—Wenderoth, Lind & Ponack

[57] ABSTRACT

A plurality of identical signal delay elements are disposed within a hoistway one for each landing floor and cascade connected to a signal generator. Each delay element is located at its position where a signal from the signal generator appears at its output with a time delay corresponding to the associated floor. The delayed signal is detected by a signal detector disposed on an elevator car stopped on or traveling past any of the floor. A time delay measurement device counts clock pulses occurring between the detected signal and the signal from the signal generator to determine a time delay between both signal and therefore the floor on which the elevator car stops, or past which it is traveling.

3 Claims, 5 Drawing Figures

ELEVATOR POSITION DETECTOR

BACKGROUND OF THE INVENTION

This invention relates to improvements in an elevator position detector device.

Elevator position detectors of the conventional construction have generally comprised a plurality of cams disposed in a hoistway one for each floor of the building served by an elevator system, a normally open switch disposed on an elevator car of the elevator system to be closed each time it abuts against a different one of the cams, and a minute mechanical simulator for the hoistway separately provided to be operated in accordance with the closure and opening of the switch thereby to indicate the position of the elevator car within the hoistway. If a failure of electric supply occurs during the travel of the electric car then the hoistway simulator indicates erroneously the position of the elevator car because the simulator is electrically coupled to the elevator car mechanically operated and therefore disabled during the failure of electric supply.

Accordingly, it is an object of the present invention to provide a new and improved elevator position detector device for detecting a position of an elevator car with an inexpensive construction utilizing only electrical means.

SUMMARY OF THE INVENTION

The present invention provides an elevator car position detector device comprising a hoistway, a plurality of landing floors disposed at equal intervals beside the hoistway, an elevator car for traveling in either of an upward and a downward direction within the hoistway and selectively stopping at the landing floors, a signal transmission line disposed along the hoistway, a signal generator for transmitting a signal to the signal transmission line, a plurality of signal delay elements disposed within the hoistway one for each landing floor and connected in a cascade manner to the signal generator through the signal transmission line to be successively applied with the signal, each of the time delay elements being located at a position where a time delay corresponding to an associated one of the landing floors is imparted to the signal passed therethrough, a signal detector disposed on the elevator car to detect the signal on the signal transmission line, and delay time measurement means connected to both the signal generator and the signal detector to measure a time delay of the signal detected by the signal detector with respect to the signal from the signal generator from which the detected signal results thereby to determine a position of the elevator car.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1A:
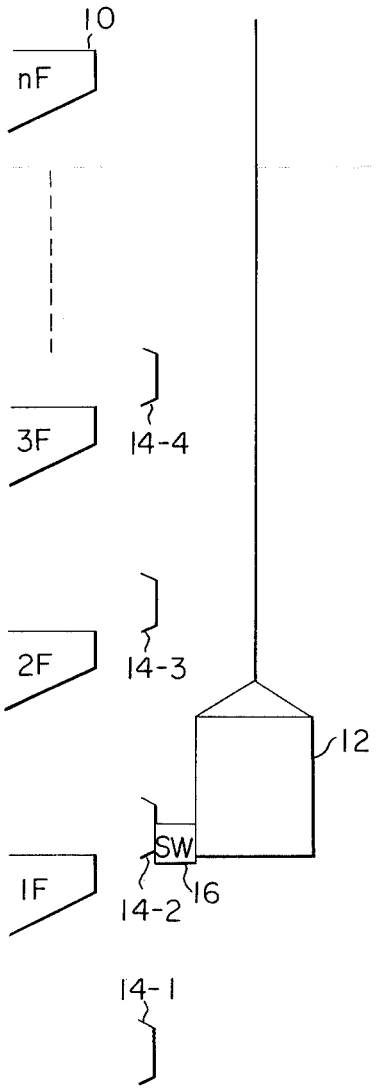
FIG. 1A PRIOR ART
FIG. 1A is a schematic diagram of that portion of a conventional elevator position detector disposed within a hoistway along which an associated elevator car travels up and down.
Figure 1B:
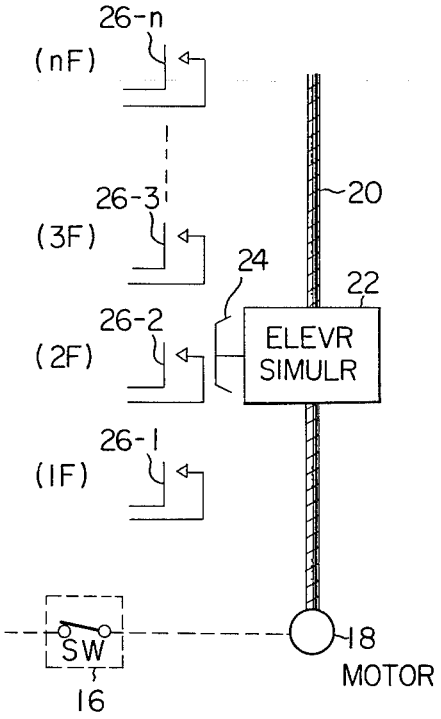
FIG. 1B PRIOR ART
FIG. 1B is a schematic elevational view of a minute simulator for the hoistway operatively coupled to the arrangement shown in FIG. 1A.

Referring now to FIGS. 1A and 1B of the drawings, there is illustrated a conventional elevator position detector. The arrangement illustrated comprises a plurality of landing floors 10 vertically disposed at predetermined equal intervals and served with an elevator car 12 arranged to ascend and descend in a hoistway which vertically extending in the vicinity of the landing floors 10. The lowermost one of the landing floors 10 is labelled 1F, that floor located just above the floor 1F is labelled 2F and so on until the uppermost landing floor 10 is labelled nF. A plurality of cams 14-1, 14-2, 14-3, . . . are disposed in vertically aligned relationship within the hoistway one for each landing floor 10. Each of the cams is shown in FIG. 1 as being located at a level lower than that of an associated landing floor 10 but somewhat above that floor disposed immediately below the associated landing floor 10. Then the elevator car 12 is provided with a normally open switch 16 adapted to abut selectively against the plurality of cams 14-1, 14-2, . . . .

In FIG. 1B an electric reversible motor 18 is electrically connected to the switch 16 shown in its closed position and mechanically connected to a ball screw rod 20. The ball screw rod 20 can be rotated with the motor 18 and a simulator 20 for the elevator car 12 is mechanically coupled to the ball screw rod 20 so that it can be moved in either of the opposite directions along the ball screw rod 20 in accordance with the rotational movement of the latter. The elevator simulator 22 includes a cam 24 somewhat extending from one side, in this case, the lefthand side as viewed in FIG. 1B thereof to be substantially perpendicular to the longitudinal axis of the ball screw rod 20. During the vertical movement of the elevator simulator 22 along the rod 20, the cam 24 selectively abuts against a plurality of sets of normally open contacts 26-1, 26-2, . . . , **26-*n* disposed at predetermined equal interval to be aligned with one another in a direction parallel to the longitudinal axis of the ball screw rod 20. Those sets of normally open contacts correspond to the respective landing floors 10 and a distance between each pair of adjacent contact sets is equal to a length diminishing and simulating the actual distance between each pair of adjacent landing floors 10. Therefore the components 18, 20, 22, 24 and 26** form a minute simulator for the hoistway.

The operation of the arrangement shown in FIGS. 1A and 1B will now be described, by way of example, in conjunction with the upward travel of the elevator car 12. Assuming that the elevator car 12 is started from the lowermost landing floor 1F, the normally open switch 16 equipped on the elevator car 12 abuts against the cam 14-2 located between that landing floor 1F and the next succeeding landing floor 2F to be closed. This closure of the switch 16 permits an electric source (not shown) to supply a current to the motor 18, rotating the motor 18 in a direction corresponding to the upward travel of the elevator car 12. This rotational movement of the rotor 18 is transferred to the ball screw rod 28 thereby to move the elevator simulator 22 away from the motor 22. During this movement of the elevator simulator 22 along the ball screw rod 20, the cam 24 disposed on the simulator 22 depresses the the set of normally open contacts 26-2 for the landing floor 2F to put the latter into its closed position. The elvator car 12 is further moved in the upward direction until the switch 16 disengages from the cam 14-2 to open the switch 16. At that time the elevator simulator 22 is stopped to move but the cam 24 remains abutting against the set of contacts 26-2. This indicates the actual position of the elevator car 12 because the set of contacts 26-2 is in its closed position until the elevator car 12 travels past the landing floor 2F and the switch 16 thereon abuts against the cam 14-3.

From the foregoing it is seen that the hoistway simulator is electrically coupled to the hoistway and mechanically operated. Therefore, conventional elevator position detectors such as shown in FIGS. 1A and 1B have been disadvantageous in that, when a failure of electric supply or the like occurs during the travel of the elevator car 12, a difference appears between the actual movement of the elevator car 12 and a corresponding movement of the simulator 22 therefor with the result that the position of the elevator car 12 is erroneously indicated. For example, it is assumed that a failure of electric supply occurs immediately before the switch 16 on the elevator car 12 abuts against the cam 14-2 for instance. Under the assumed condition the elevator car 12 may move some distance in the direction of travel thereof due to its inertia. As a result, the elevator car 12 may be stopped after the switch 14 thereon has abutted against the cam 14-2 and then passed past the latter. In this case, the motor 18 is not rotated because of the failure of electric supply and therefore among the plurality of contact sets 26-1, 26-2, . . . , 26-*n* that contact set in its closed position remains closed. In other words, the switch 16 is in engagement with the cam 14-2 and nevertheless the motor 18 is not rotated. As a result, the simulator 22 indicates a position of the elevator car 12 different from the actual position thereof.

The present invention aims at the provision of an elevator position detector device for detecting a position of an elevator car with an inexpensive construction utilizing only electrical means without relying upon electro-mechanical means previously employed.

Figure 2:
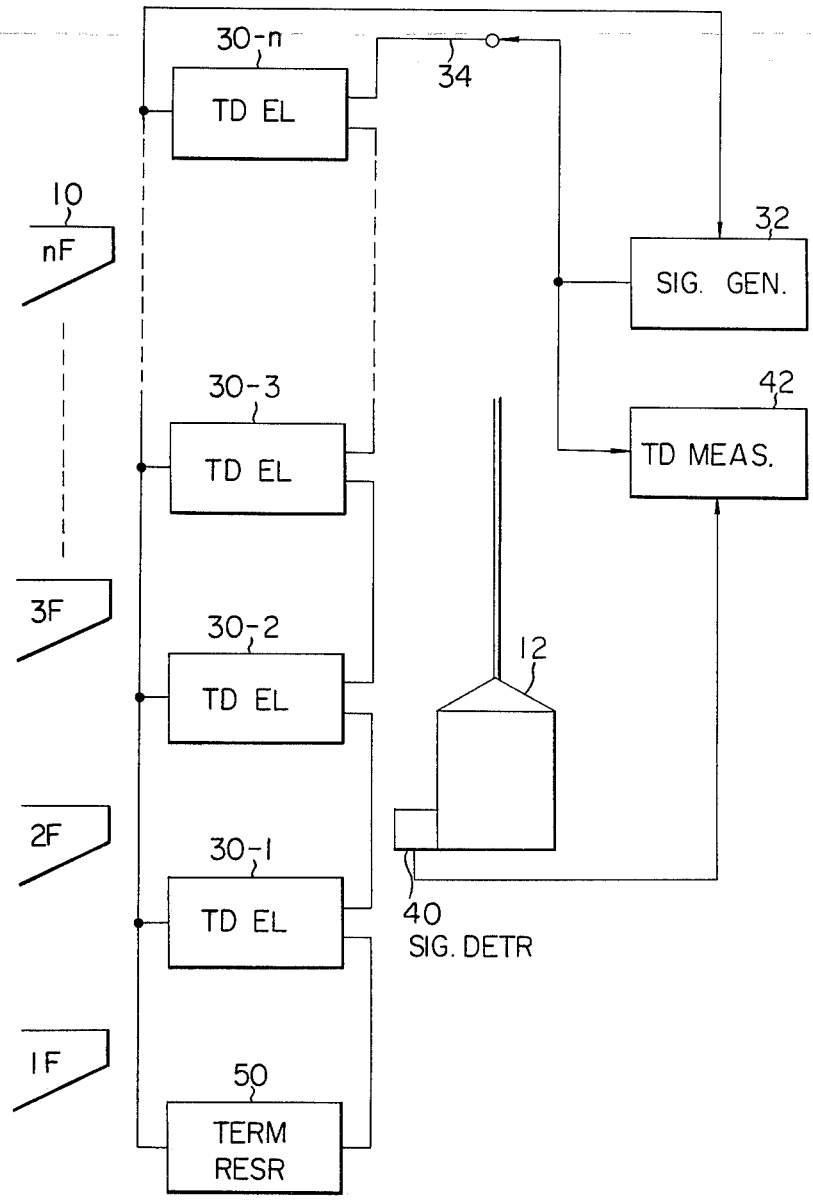
FIG. 2 is a block diagram of one embodiment according to the elevator position detector device of the present invention.

Referring now to FIG. 2 wherein like reference numerals designate the components identical or corresponding to those shown in FIG. 1A, there is illustrated one embodiment according to the elevator position detector device of the present invention. The arrangement illustrated comprises a plurality of signal delay elements 30-1, 30-2, 30-3, . . . , 30-*n* disposed at equal interval in vertically aligned relationship within the hoistway so that a different one thereof is located between each pair of adjacent landing floors 10 except for the uppermost signal delay element 30-*n*. For example, the lowermost signal delay element 30-1 is located between the lowermost landing floor, in this case, the first floor 1F and the second landing floor 2F. The uppermost signal delay element 30-*n* is located at its level higher than that of the uppermost landing floor *n*F so that it is vertically spaced from that signal delay element 30-(n−1) (not shown) disposed immediately therebelow by an interval equal to that between each pair of adjacent delay elements.

Then a signal generator 32 is connected to one side, in this case, the lefthand sides of all the signal delay elements through a common lead serving as a signal return lead and also successively connected to the other or righthand sides thereof through respective leads which serve as signal sending leads. The signal sending leads and the signal return lead form a signal transmission cable or line 34 that is disposed along the hoistway and terminates in a terminating impedance 50 such as a resistor located at a predetermined distance below the lowermost floor 1F.

Figure 3A:
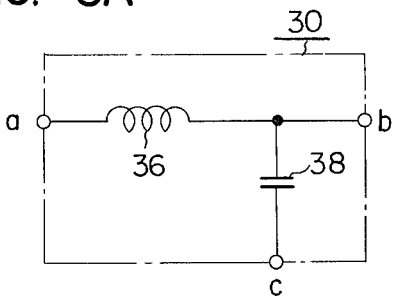
FIG. 3A is the fundamental circuit configuration of the time delay elements shown in FIG. 2.

The signal delay elements 30-1, 30-2, . . . , 30-*n* are identical to one another and preferably of a circuit configuration as shown in FIG. 3A. As shown in FIG. 3A, the signal delay element generally designated by the reference numeral 30 includes an inductor 36 having an inductance L and connected between an input terminal a and an output terminal b, and a capacitor 38 having a capacitance c and connected across the output terminal b and a common return terminal c. Therefore the signal delay element 30 is in the form of an L-C filter.

Figure 3B:
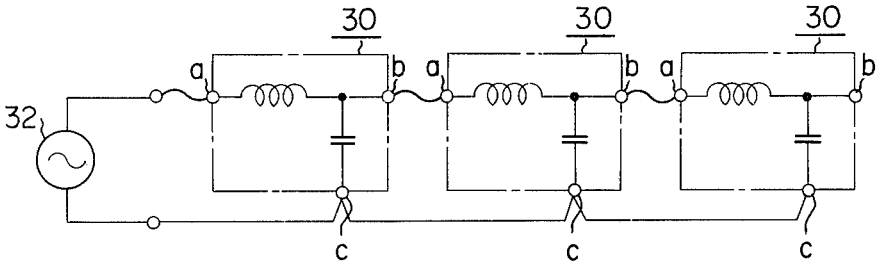
FIG. 3B is a circuit diagram of cascade connected time delay elements useful in explaining the operation of the arrangement shown in FIG. 2.

FIG. 3B is a circuit diagram of the signal delay elements interconnected as above described in conjunction with FIG. 2. In FIG. 3B, a first one of the signal delay elements also designated by the reference numeral 30 includes the input and return terminals a and c respectively connected across the signal generator 32 through a pair of leads and the output terminal b connected to the input terminal a of a second one of signal delay elements 30 through a lead labelled the reference character A. On the other hand, those signal delay elements 30 have the return terminals c interconnected through a lead. The second signal delay element 30 is similarly connected to the next succeeding signal delay element 30.

The first signal delay element 30 shown in FIG. 3B corresponds to the uppermost signal delay element 30-*n* shown in FIG. 2 while the leads connected to the input and output terminals of the signal delay elements correspond to the signal sending leads shown in FIG. 2 and the lead connected to the return terminals thereof corresponds to the signal return lead also shown in FIG. 2.

From the foregoing it is seen that the plurality of signal delay elements 30-1, 30-2, . . . , 30-*n* are interconnected in a cascade manner to form an L-C ladder type network.

It is well known that, when in FIG. 3B the signal generator 32 applies a signal having, for example, a sinusoidal or a rectangular waveform across the input and return terminals a and c respectively of the first signal delay element 30, that signal is developed across the output and return terminals b and c thereof or on the lead A with a time delay. Assuming that the signal sending and return leads have negligibly low impedances, that time delay is equal to a delay time constant T as determined by the inductance L and the capacitance C included in the signal delay element 30. Then the signal is developed on the lead b connected to the output terminal b of the second signal delay element 30 with a time delay of 2T with respect to the signal as delivered from the signal generator 32.

Referring back to FIG. 2, the signal from the signal generator 32 is successively passed through the signal delay elements 30-*n*, . . . , 30-2, 30-1, with time delays of T, 2T, . . . , (n−1)T and nT respectively.

Then the elevator car 12 includes a signal detector 40 disposed thereon at its position where it is not contacted by the signal transmission line 34 as shown in FIG. 2.

Alternatively, the signal detector 40 may be located to contact the signal transmission line 34. In each case, the signal detector 40 is operative to detect a signal propagating along the signal transmission line 34.

The signal detector 40 is connected to a delay time measurement device 42 to which the signal generator 36 is also connected. In order to measure the time delay of the signal propagating along the signal transmission line 34, the delay time measurement device 42 may be preferably in the form of a counter. Then a clock device (not shown) supplies a train of clock pulses having a pulse repetition frequency of 1/T to the measurement device 42. The measurement device 40 is started to count the clock pulses in response to a signal delivered to the signal transmission line 34 from the signal generator 32 and terminates counting them in response to the signal on the line 34 detected by the signal detector 40. The resulting count indicates a time delay of the particular signal with respect to the signal delivered from the signal generator 32.

It is assumed that the elevator car 12 pauses on the landing floor 2F as shown in FIG. 2. Under the assumed condition the signal detector 40 detects a signal delivered to the signal transmission line form the signal generator 32 and having passed through the signal delay elements **30-*n*, . . . 30-3, and 30-2 whose number is (n−1). The detected signal is applied to the delay time measurement device 42 where a time delay thereof is measured with respect to the signal as delivered from the signal generator 32 and in the manner as above described. Thereby the measurement device 42 determins that the detected signal has the time delay of (n−1)T with respect to the signal as delivered from the signal generator 32 because the measured signal has passed through the n−1 signal delay elements having the equal time constants of T. As a result, it has been determined that the elevator car 12 is at standstill on the landing floor 2F**. This is because each of the signal delay elements is located above the associated landing floor and imparts an equal time delay of T to a signal having passed therethrough.

Therefore it is seen that the arrangement of FIG. 2 can easily identify any landing floor on which the elevator car pauses, on the basis of the time delay T which is imparted to a signal as having passed through each of the signal delay elements.

Also it will readily be understood that the arrangement of FIG. 2 can easily identify any landing floor past which the elevator car is traveling in the same manner as above described.

The present invention has several advantages. For example, the maintenance is simplified and any difference between the actual and detected positions of an elevator car does not occurs because the present invention does not includes any mechanical components required for conventional elevator position detectors of the electromechanical structure. Also, upon the occurrence of a failure of electric supply, the actual position of the elevator car can be easily identified by transmitting a signal to the signal delay elements from the signal generator after the restoration of electric supply. Further all the signal delay elements can have the identical characteristics without imparting to them singularties due to associated landing floors.

While the present invention has been illustrated and described in conjunction with a single preferred embodiment thereof it is to be understood that numerous changes and modifications may be resorted to without departing from the spirit and scope of the present invention. For example, each of the signal delay elements is not required to be in the form of an L-C filter illustrated and may be of any desired circuit configuration. Also, it is not necessary for the signal delay elements to be located between adjacent landing floors and they may be disposed at positions where time delays corresponding to the corresponding landing floors are developed on the signal transmission line.

What I claimed is:

1. An elevator position detector device comprising, a hoistway, a plurality of landing floors disposed at equal intervals beside said hoistway, an elevator car for traveling in either of an upward and a downward direction within said hoistway and selectively stopping at said landing floors, a signal transmission line disposed along said hoistway, a signal generator for transmitting a signal to said signal transmission line, a plurality of signal delay elements disposed within said hoistway one for each landing floor and connected in a cascade manner to said signal generator through said signal transmission line to be successively applied with said signal, each of said signal delay elements being located at a position where a time delay corresponding to the associated landing floor is imparted to said signal passed therethrough, a signal detector disposed on said elevator car to detect said signal on said signal transmission line, and delay time measurement means connected to both said signal generator and said signal detector to measure a time delay of said signal detected by said signal detector with respect to signal delivered by said signal generator from which said detected signal results, thereby to determine a position of said elevator car.

2. An elevator position detector device as claimed in claim 1 wherein each of said signal delay elements is in the form of an L-C filter including an inductor and a capacitor.

3. An elevator position detector device as claimed in claim 1 wherein said delay time measurement means has applied thereto a train of clock pulses having a pulse repetition frequency of 1/T where T designates a time delay imparted to said signal by each of said signal delay elements, said delay time measurement means being responsive to said signal delivered from said signal generator to be initiated to count said clock pulses and responsive to said signal detected by said signal detector to terminate counting said clock pulses.

* * * * *